United States Patent [19]

Hughlett et al.

[11] Patent Number: 4,905,566

[45] Date of Patent: Mar. 6, 1990

[54] ROTATIONALLY BALANCED DRUMSTICK

[76] Inventors: David J. Hughlett, 3747 McMillan #103, Dallas, Tex. 75206; Jimmy R. Evans, 2235 Aspen, Dallas, Tex. 75227

[21] Appl. No.: 365,707

[22] Filed: Jun. 14, 1989

[51] Int. Cl.[4] ..... G10D 13/02

[52] U.S. Cl. ..... 84/422.4

[58] Field of Search ..... 84/422.4

[56] References Cited

U.S. PATENT DOCUMENTS

| | | | |
|---|---|---|---|
| 1,739,275 | 12/1929 | Zipperstein | 84/422.4 |
| 3,146,659 | 9/1964 | Robba et al. | 84/422.4 |
| 3,147,660 | 9/1964 | Brilhart | 84/422.4 |
| 3,301,119 | 1/1967 | Gilbert | 84/422.4 |
| 3,489,052 | 1/1970 | Colyer et al. | 84/422.4 |
| 4,385,544 | 5/1983 | Heiskell | 84/422.4 |
| 4,557,176 | 12/1985 | Boturia | 84/422.4 |
| 4,763,557 | 8/1988 | Donohoe | 84/422.4 |

*Primary Examiner*—Lawrence R. Franklin

*Attorney, Agent, or Firm*—Morgan L. Crow

[57] ABSTRACT

An improved drumstick is disclosed having a striking tip, a tapered portion, and a straight portion terminating in a butt end and having the center of gravity 35% to 41% from the butt end. There is also disclosed an improved tympani stick having a striking head, and a handle terminating in a butt end, the improvement comprising a weight added near the butt end sufficient to balance the tympani stick 35% to 41% from the butt end.

9 Claims, 1 Drawing Sheet

ROTATIONALLY BALANCED DRUMSTICK

BACKGROUND OF THE INVENTION

1. Field of the Invention

This invention relates in general to drumsticks and in particular to the location of the center of gravity of the drumstick near the point where the drumstick is rotated when being used to play a percussion instrument.

2. Prior Art

Drummers have become accustomed to the "feel" of traditional wood drumsticks. The center of gravity, or center of balance has been determined by the well known shape of the drumstick having a striking tip mounted on a tapered section and a straight shank and made of a relatively uniform density wood. Investigation shows that this traditional wood drumstick has a center of gravity located 42% to 57.3% of the way from the back or butt end of the drumstick.

Wood drumsticks have some less than optimum characteristics in the lack of complete uniformity, lack of durability in use and lack of adequate strength. These deficiencies have given rise to many efforts to improve drumsticks by manufacturing them from metals, plastics, and other materials. Numerous patents have been issued on drumsticks made of these synthetic materials, and in most cases, wood drumsticks have been cited as the desired goal for tonal characteristics and "feel" to the user.

In U.S. Pat. No. 3,301,119, A. M. Gilbert discloses metal drumsticks and reports on investigation of the center of balance of several drumsticks and disclosed that the center of balance of several available drumsticks varied from 42.0 to 57.3% from the Butt end of the drumsticks. This patent stated as part of the primary object of the invention to "achieve the weight and "feel" of the wooden drumstick.

In U.S. Pat. No. 3,165,964, Harold R. Stys discloses metal drumsticks. In col. 2, line 33 he states that "Drummers are accustomed to the weight of wooden drumsticks and find that drumsticks which deviate from this weight for a given size are seriously objectionable."

In U.S. Pat. No. 4,385,544 Ronald E. Heiskell discloses a drumstick made of rolled, impregnated fabric. In col. 6, lines 9 to 15 he discloses a drumstick 16 inches long with the center of gravity 7 to 7½ inches from the butt cap. These proportions are 43.75 to 46.875% from the butt end. In the cited passage, it is stated that "These values all fall within accepted characteristics of wooden drumsticks."

U.S. Pat. No. 2,521,336 to M. Branson, discloses a drumstick which is hollow and has weights inserted therewithin. There is, however, not teaching as to an improved location for the center of gravity.

In the prior art there have been many efforts toward making a drumstick of better tonal quality, better "feel" for the user, more durability, more uniform properties, and reduced cost. No one, however has achieved significant progress toward these long felt needs.

SUMMARY OF THE INVENTION

It is an important object of this invention to provide a drumstick balanced to locate the center of gravity nearer the natural fulcrum location the percussionist uses when playing a percussion instrument with the present invention.

It is another object of this invention to provide a drumstick which has a better "feel" for the musician.

It is still another object of this invention to provide a drumstick which can provide a more solid impact.

It is a still further object of this invention to provide a drumstick which will provide better tonal quality.

It is a still further object of this invention to provide a drumstick of wood, metal, plastic, or other synthetic material and having improved balance.

It is a still further object of this invention to provide a drumstick with faster response.

It is a still further object of this invention to provide a drumstick with improved "feel" over that of the wood drumstick which has in the past been the long sought standard of performance.

BRIEF DESCRIPTION OF THE DRAWINGS

The foregoing and other objects of this invention, which will become more apparent from the following detailed description of an embodiment thereof may be achieved by the apparatus herein described by way of example in connection with the illustration of its structural components in the accompanying drawing in which.

DESCRIPTION OF THE PREFERRED EMBODIMENT

Figure 1:
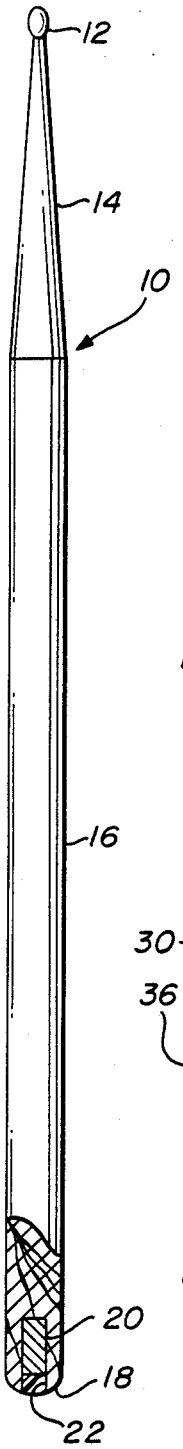
FIG. 1 is a partial cross section of the present invention.

Referring now to FIG. 1, there is illustrated a drumstick 10 incorporating the present invention. The drumstick 10 is of a conventional drumstick shape, provided with a striking tip 12 for use in engagement with a percussion instrument. A tapered shank 14 connects the striking tip 12 to the handle 16 which terminates at the butt end 18. The striking tip 12 may be integral with a wood drumstick or a tip made of another material and applied to the drumstick. A weight 20, preferably a heavy metal such as lead, is inserted in a hole 22 in the butt end of the drumstick 10 and fixed in place, preferably with adhesive, so that the weight is positioned near the butt end. Prior art wood drumsticks differ from the instant invention in the absence of the hole 22 and weight 20.

For the purposes of this specification, we will refer to a drummer, and by this reference we will include anyone playing drums, tom-toms, cymbals, cowbells, bongos, marimbas, or any other percussion instrument. For the purposes of this specification, balance point and center of gravity are equivalent terms. For the purposes of this specification, synthetic materials for drumsticks comprises metal, plastic, and resin, with or without reinforcement by cloth or fibers.

We have conducted balance tests on numerous wood and synthetic drumsticks. Drumsticks were measured as to length, diameter, weight, and distance from butt end to the balance point or center of gravity in percentage. Results of some of these tests are as follows:

| Quantity | Description | Distance, Butt End to Balance Point Min. | Max | Avg. |
|---|---|---|---|---|
| 6 | Vic Firth 5a | 44.92 | 45.97 | 45.73 |
| 4 | Vic-Firth 5a NT | | | |
| 1 | Grafite Riff Rit | 46.25 | 46.25 | 46.25 |
| 4 | Zildjian 2B NT | 45.53 | 48.92 | 46.58 |
| 4 | Pro-Mark 2B | | | |
| 4 | Pro-Mark 2B NT | | | |
| 6 | Regal Tip Corps 662 | 46.77 | 46.97 | 46.90 |
| 4 | Zildjian 5b | 45.79 | 46.77 | 46.23 |
| 4 | Pro-Mark 5B | | | |
| 4 | Pro-Mark 5B NT | | | |
| 4 | Vic-Firth SD4 | 45.65 | 46.05 | 45.85 |
| 8 | Vic-Firth SD2 | 42.99 | 43.85 | 43.47 |
| 6 | Vic-Firth SD1 | 45.80 | 47.33 | 46.44 |
| 6 | Pro-Mark Phil C | 43.85 | 44.05 | 43.98 |
| 4 | Vic-Firth Rock | 46.17 | 46.73 | 46.50 |
| 6 | Pro-Mark Jazz NT | 45.99 | 48.24 | 46.78 |
| 6 | Pro-Mark Jazz Hic | | | |

In the book, Understanding Drum Techniques by David Hughlett, one of the present joint inventors, on page 4, it is taught that the drumstick is to be considered as a lever, revolving about a fixed point called a fulcrum. This fulcrum is the grip point about which the drumstick rotates with respect to the hand. In playing a percussion instrument, the drumstick is rotated about an axis in space established by the drummer generally lateral to the axis of the drumstick. To play properly, a drummer establishes a stable fulcrum or grip point with the hand between the thumb and base of the index finger. The fulcrum point should be established approximately one third of the way from the butt end toward the tip of the drum stick. The drumstick remains at the fulcrum and is rotated by movement of the hand to strike and play the percussion instrument. The point where the stick is held by the hand should not be the balance point of the drumstick. Due to the natural movement employed by a drummer, when the forearm is used to move the drumstick, the rotational point of the stick is forward approximately 35% to 41% from the butt end of the drumstick, and forward from the grip point where the drumstick is held by the hand. Therefore it can be seen with our invention the drumstick is rotated about a point forward of the grip point with the hand and very near to the balance point of the drumstick.

We have established that the 42.99% to 48.92% distance from the butt end to the center of gravity, as reported in the above tests, contributes to the conventional "feel" of drumsticks. According to prior art cited above, Gilbert in U.S. Pat. No. 3,301,119 discloses that drumsticks have the center of gravity 42.0 to 57.3% from the butt end of the drumsticks, which apparently contributes to the conventional "feel" of these prior art drumsticks. We have discovered that drumsticks having the balance point positioned 35% to 41% of the drumstick length from the butt end have the balance point nearer the fulcrum the drummer uses to play with the drumsticks achieves the objects of this invention.

Figure 2:
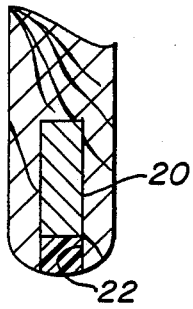
FIG. 2 is a partial cross section of the butt end of the preferred embodiment.

Referring to FIG. 2, a wood or synthetic drumstick can be made according to the preferred embodiment of this invention. A drumstick of the conventional shape is balanced on a sharp edge to find the balance point. The required weight of a lead rod may be calculated by conventional calculations, or may be found by trial and error. Hole 22 is drilled into the butt end of the drumstick, and weight 20 of the required size is fastened in hole 22 with a strong adhesive such as epoxy, cyanoacrylate, or other adhesive. It should be understood another substance could be selected rather than lead.

Figure 3:
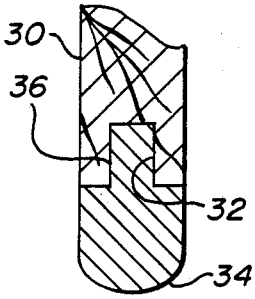
FIG. 3 is a partial cross section of the butt end of an alternate embodiment.

Referring now to FIG. 3, an alternate embodiment is illustrated. A drumstick 30 has a hole 32 formed in the butt end. A weight 34 formed with an extension 36 shaped to fit into hole 32. Weight 34 is attached to the drumstick with adhesive as described above, or may be attached by threads between extension 36 and hole 32 or other means of attachment.

Figure 4:
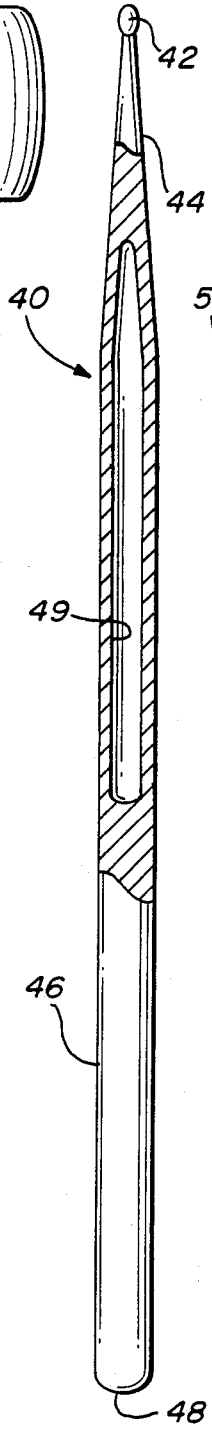
FIG. 4 is a cross section of still another alternate embodiment.

FIG. 4 illustrates still another alternate embodiment of our invention. Drumstick 40 has a striking tip 42, a tapered shank 44, a straight handle 46 terminating in a butt end 48. The tapered shank 44 and straight handle 46 are constructed of synthetic materials and have a cavity 49 in the interval between the center of gravity and the striking tip 42 such that the center of gravity is located 35% to 41% of the length of the drumstick from the butt end 48 toward the striking tip 42. With various densities of synthetic materials available, it is possible to construct a drumstick having the balance point 35% to 41% from the butt end. The cavity 49 in the drumstick between the balance point can be utilized to aid in positioning the balance point of the drumstick for the desired proportion.

Figure 5:
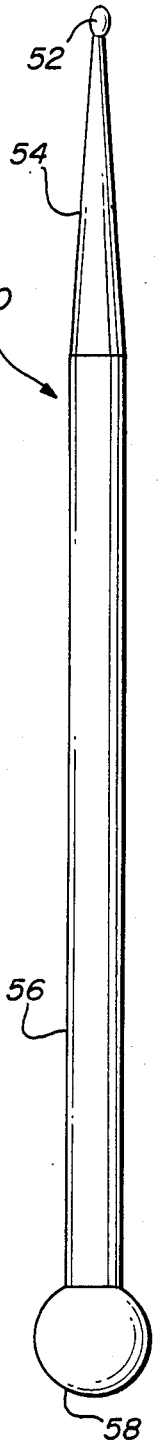
FIG. 5 is a partial cross section of a still further embodiment of our invention.

Referring now to FIG. 5, still further alternate embodiment is shown by drumstick 50, made of wood, synthetic material or metal, and having striking tip 52 connected to tapered shank 54 connected in turn to straight shank 56, terminating at butt end 58. The butt end 58 is enlarged to add weight in order to position the center of gravity 35% to 41% of the distance from the butt end 58 of the drumstick toward the striking tip 52. The enlarged portion at the butt end 58 can be any shape so long as it is large enough to achieve the positioning of the center of gravity within the desired range and is comfortable to hold and use by the drummer.

Figure 6:
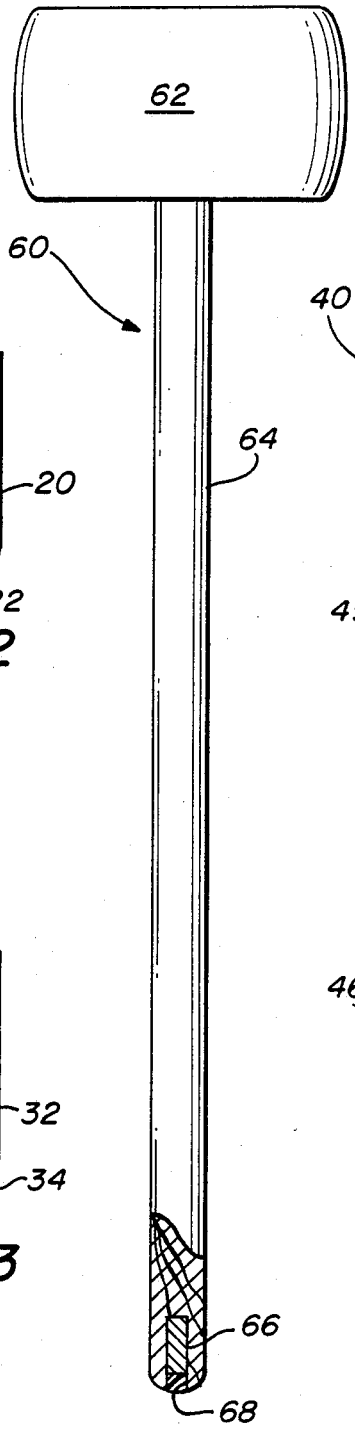
FIG. 6 is a partial cross section of a tympani stick according to our invention.

Referring now to FIG. 6, a tympani stick 60 according to our invention is illustrated. A striking head 62 is mounted on a handle 64, a weight 66 is inserted in a hole 68 in the butt end of the handle and secured by one of the means described hereinbefore. The weight 66 is sized to position the center of gravity 35% to 41% from the butt end of the tympani stick. The use of the tympani stick is similar to that described earlier and is well known in the art. Our invention attains similar improvements in "feel" and use as in drumsticks described earlier.

In use, drumsticks made according to our invention have the center of gravity closer to the fulcrum about which the drummer rotates the drumsticks to strike the instrument. The resulting rotation of the drumstick nearer the balance point results in a more solid "feel" to the drummer. The closer location of the center of balance to the fulcrum results in less centrifugal force tending to pull the drumstick axially of the drumstick out of the drummer's hand as the drummer rotates the drumstick to strike the instrument as hereinbefore described. Less grip is therefore required to hold on to the drumstick.

A further advantage of our drumstick in use is that the weight used to shift the center of gravity adds weight to the drumstick, adding the inertia of the drumstick, resulting in a more firm impact of the drumstick on the drumhead or instrument, resulting in improved tonal qualities, and improved "feel" to the drummer.

In order to prove that the objects of our invention had been met, a number of test sets of drumsticks have been manufactured by the joint inventors according to this invention. Then 12 professional drummers were asked to try these drumsticks; of these, 9 liked the drumsticks and reported significant improvement in the "feel" and other operational characteristics; 2 said they liked the drumsticks, but would have to become accustomed to them; 1 professional drummer only played one song, but did not particularly care for them. In summary, 11 out of 12 professional drummers liked drumsticks made according to our invention the first time they used them. Several of the professional drummers have continued to test our drumsticks, and all of drummers conducting continuing tests like the test drumsticks. Reports included "more comfortable to use," and "more responsive." Another professional drummer reported that the test drumsticks "come up faster," which means that the drumsticks seemed to him to rebound more quickly after striking the drumhead. Still another professional drummer reported that with the test drumsticks it is "easier to play loud with less effort."

Even people who do are not drummers can tell an immediate and significant difference in the tone and "feel" of standard wood drumsticks and drumsticks according to our invention. While we have shown and described certain embodiments of our drumstick, it is to be understood that it is subject to modifications without departing from the scope and spirit of the following claims.

We claim:

1. A drumstick having a butt end and a striking tip at the other end, and having the center of gravity 35% to 41% inclusively from the butt end.

2. An improved drumstick having a striking tip, a tapered portion, and a straight portion terminating in a butt end, the improvement comprising a weight added near the butt end sufficient to balance the drumstick 35% to 41% from the butt end.

3. The drumstick of claim 2 wherein the drumstick is wood.

4. The drumstick of claim 3 wherein the striking tip is synthetic material.

5. The drumstick of claim 2 wherein the drumstick is metal or synthetic material.

6. The drumstick of claim 2 wherein the weight is lead.

7. A drumstick having an overall length and including a striking tip at one end, a tapered portion connected to the striking tip, a straight portion connected to the tapered portion, terminating in a butt end, and a weight, the butt end adapted to receive the weight, and the weight sized to position the center of gravity of the drumstick 35% to 41% of the overall length from the butt end.

8. A tympani stick having a butt end and a striking head at the other end, and having the center of gravity 35% to 41% inclusively from the butt end.

9. An improved tympani stick having a striking head, and a handle terminating in a butt end, the improvement comprising a weight added near the butt end sufficient to balance the tympani stick 35% to 41% from the butt end.

* * * * *